US006318380B1

(12) United States Patent
Hwang

(10) Patent No.: US 6,318,380 B1
(45) Date of Patent: Nov. 20, 2001

(54) BRUSH HAVING POWDER TUBE AND SLIDABLE BRUSH GUIDE

(75) Inventor: Jae Kwang Hwang, Seoul (KR)

(73) Assignee: F.S. Korea Industries Inc., Seoul (KR)

( * ) Notice: Subject to any disclaimer, the term of this patent is extended or adjusted under 35 U.S.C. 154(b) by 0 days.

(21) Appl. No.: 09/636,640

(22) Filed: Aug. 11, 2000

(30) Foreign Application Priority Data

Jan. 21, 2000 (KR) ..... 2000-1642

(51) Int. Cl.[7] ..... A45D 33/02
(52) U.S. Cl. ..... 132/298; 132/313; 401/156
(58) Field of Search ..... 132/313, 293, 132/298, 299, 307, 290, 311; 15/160, 175, 172, 201, DIG. 4; 401/118, 126, 129, 156, 183, 282, 286, 158, 159, 160, 161, 162, 163, 164, 165, 166, 167, 168, 169

(56) References Cited

U.S. PATENT DOCUMENTS 1,258,677 * 3/1918 Haskell ..... 401/278
1,618,731 * 2/1927 Routh ..... 222/103
1,857,027 * 5/1932 Mah ..... 401/160
2,009,761 * 7/1935 Calderara ..... 222/92
5,186,563 * 2/1993 Gebhard et al. ..... 401/153
5,339,483 * 8/1994 Byun ..... 15/184
6,234,181 * 5/2001 Lou ..... 132/313

* cited by examiner

*Primary Examiner*—Gene Mancene
*Assistant Examiner*—David Comstock
(74) *Attorney, Agent, or Firm*—Finnegan, Henderson, Farabow, Garrett, & Dunner, L.L.P.

(57) ABSTRACT

A cosmetic brush having a powder tube, the powder tube being made of an elastic material, for accommodating powder, and the brush being installed at the upper portion of the powder tube, for uniformly applying powder sprayed from the powder tube to the face directly. The brush is incorporated in a housing comprised of an upper case and a lower case, and the lower case includes a lower cap which allows the powder tube to be separated for replacement. A brush guide is vertically movably installed inside the upper and lower cases. A pressing device for pressing the powder tube is provided in the lower case to supply powder.

1 Claim, 6 Drawing Sheets

BRUSH HAVING POWDER TUBE AND SLIDABLE BRUSH GUIDE

BACKGROUND OF THE INVENTION

1. Field of the Invention the present invention relates to a cosmetic brush having a powder tube, and more particularly, to a cosmetic brush having a powder tube, in which powder and a brush necessary for make-up are incorporated to be simultaneously used for make-up, without a need of separately applying the powder and scrubbing the face.

2. Description of the Related Art

In conventional cosmetic products there have been separately provided a container for storing powder and sponge for applying powder to the user's face and a brush for uniformly distributing the powder on the face, and they are sequentially used when performing make-up. Also, several cosmetic products must be separately purchased for performing make-up in a desired manner.

SUMMARY OF THE INVENTION to solve the above problems, it is an object of the present invention to provide a cosmetic brush having a powder tube, configured to allow make-up using a brush Simultaneously with spraying powder, Such that the brush and a replaceable powder tube disposed in the lower portion of a brush incorporated housing are combined with a nozzle-type powder lid having spray orifices formed therein.

To accomplish the above object of the present invention, there is provided a cosmetic brush having a powder tube, including an elastic powder tube for accommodating powder, and a brush installed in the upper portion of the powder tube. for uniformly distributing the powder sprayed from the powder tube to the user's face.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

A cosmetic brush having a powder tube will now be described in detail.

Figure 1:
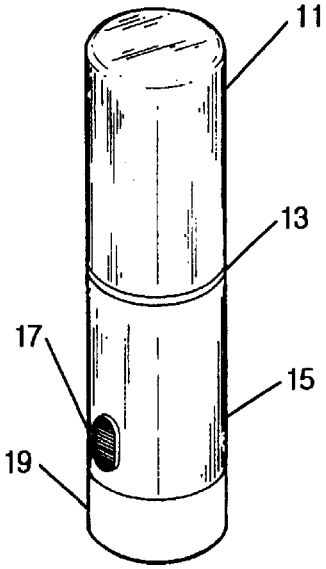
FIG. 1 is a perspective view of a cosmetic brush having a powder tube according to the present invention.
Figure 2:
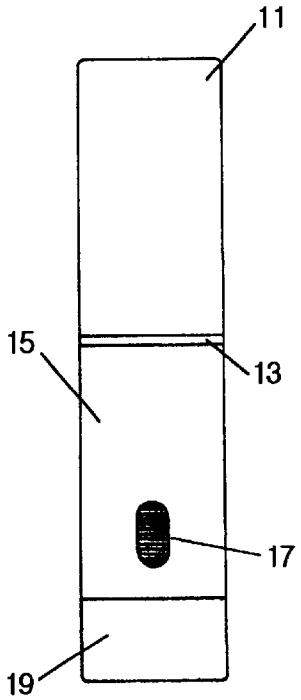
FIG. 2 is a front view of FIG. 1.
Figure 3:
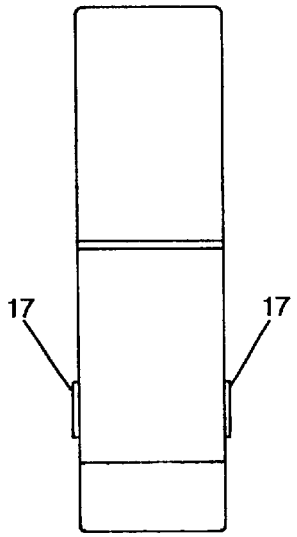
FIG. 3 is a side view of FIG. 1.
Figure 6:
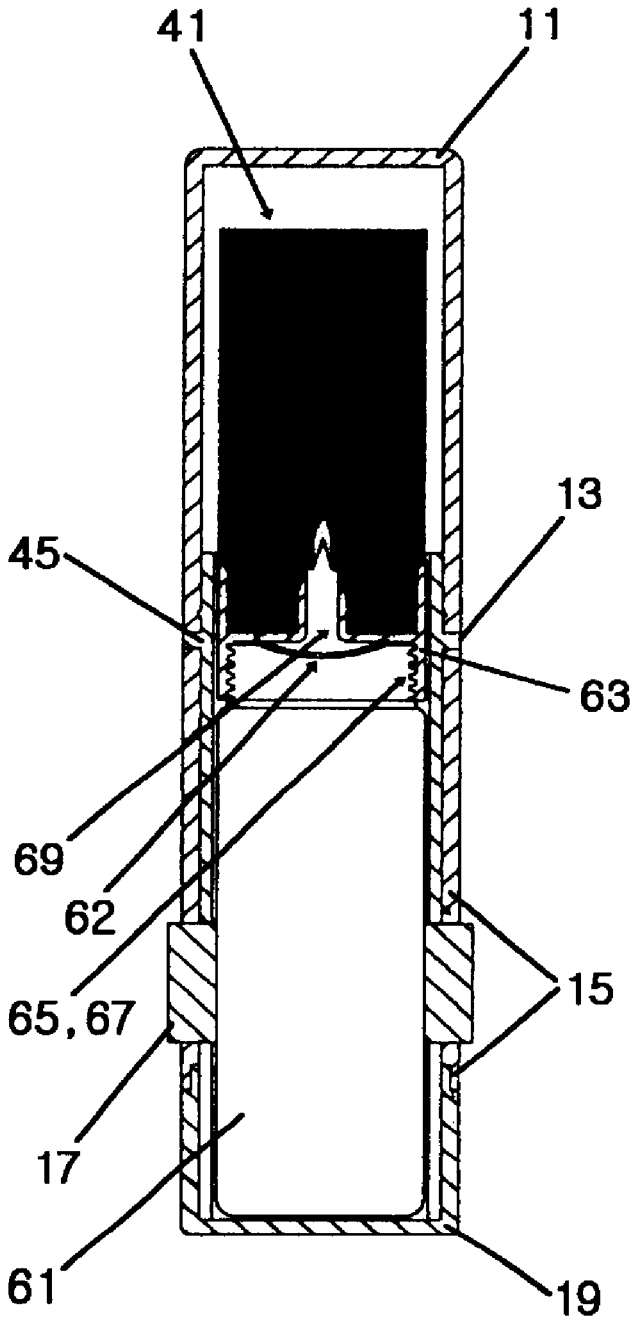
FIG. 6 is a cross-sectional view of FIG. 3.
Figure 7:
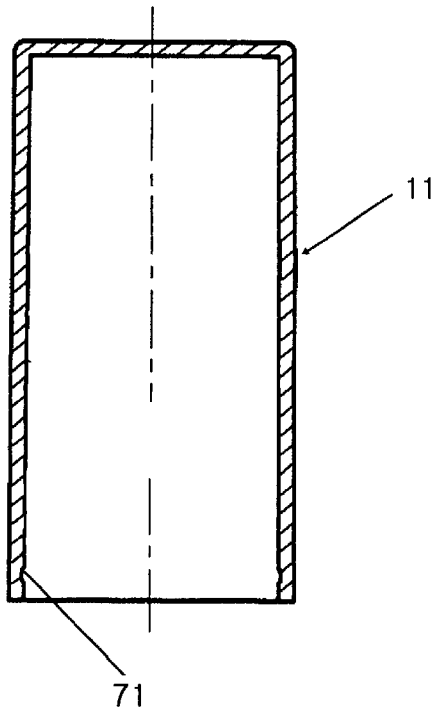
FIG. 7 is a cross-sectional view of an upper case.
Figure 8:
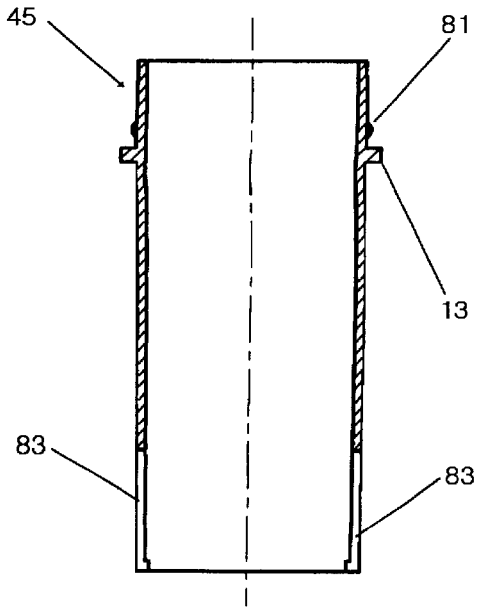
FIG. 8 is a cross-sectional view of a brush guide.
Figure 9:
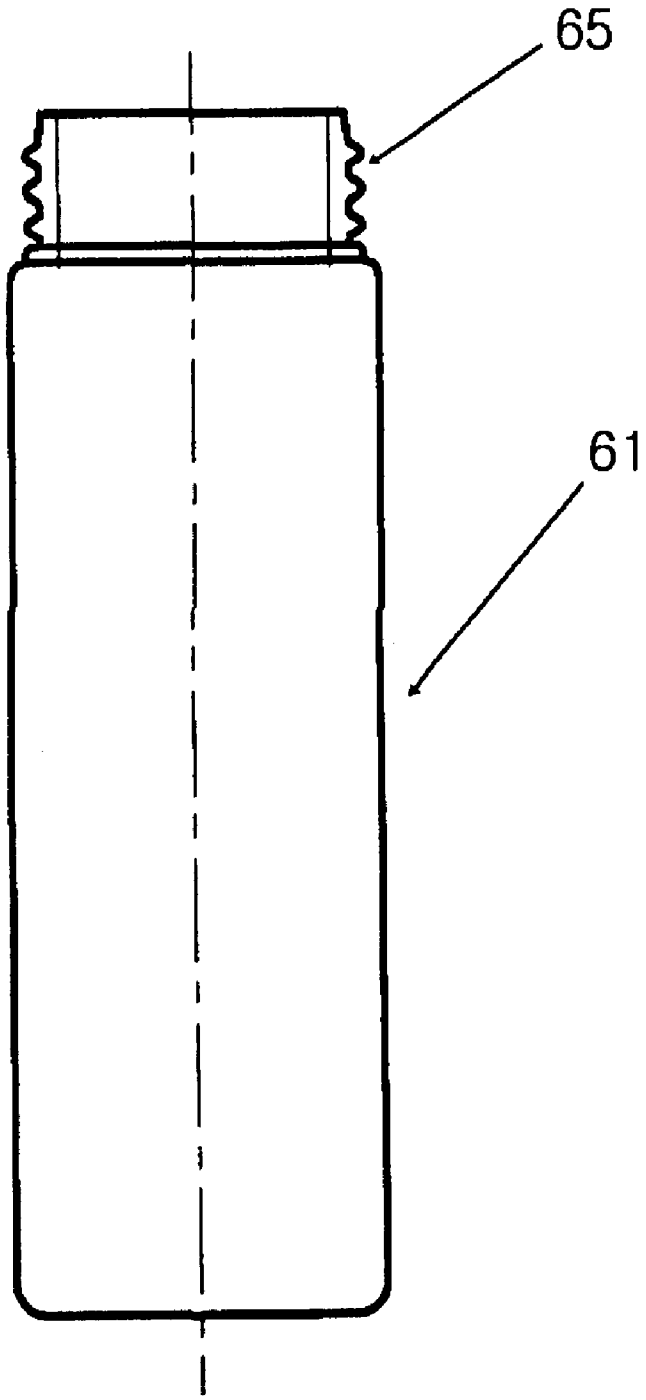
FIG. 9 is a cross-sectional view of a powder tube.

FIG. 1 is a perspective view of a cosmetic brush having a powder tube according to the present invention, FIG. 2 is a front view of FIG. 1, and FIG. 3 is a side view of FIG. 1. In FIG. 1, the cosmetic brush having a powder tube is largely comprised of an upper case ( 11 of FIG. 7), a lower case 15 and a lower cap 19. The upper case 11 and the lower case 15 are fittingly inserted into upper and lower ends of a locking part 13 protruding on the outer surface of a tube-like brush guide (45 of FIG. 8). As shown in FIG. 6, in the lower case 15, a powder tube 61 inserted into the lower case 15 and a powder lid 63 having a female screw 67 threaded with a male screw (65 of FIG. 9) of the powder tube 61, are connected in a state in which they are practically in contact with the inner Surface of the tube-like brush guide 45. The lower case 15 and the lower cap 19 are connected by a screw. The powder tube 61 is inserted through the bottom of the present apparatus to be replaced by means of the detachable lower cap 19. A brush 41 having densely distributed bristles is fixed on the top surface of the powder lid 63. A spray orifice 69 is formed on the upper inner surface of the powder lid 63, like a nozzle for easily spraying the powder. In the above-described embodiment, the powder tube 61 and the powder lid 63, and the lower case 15 and the lower cap 19, are connected by a screw. However, any method that facilitates connection can be used.

Figure 4:
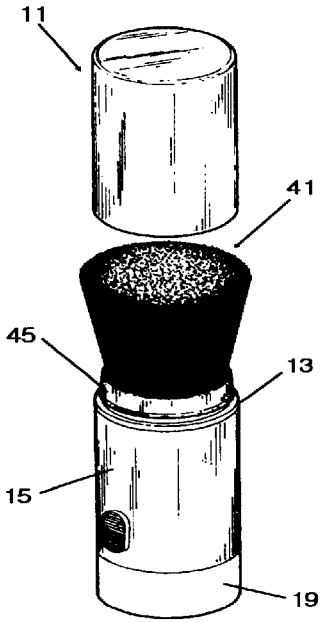
FIG. 4 is a perspective view of a cosmetic brush having a powder tube in a state in which an upper case is opened.
Figure 5:
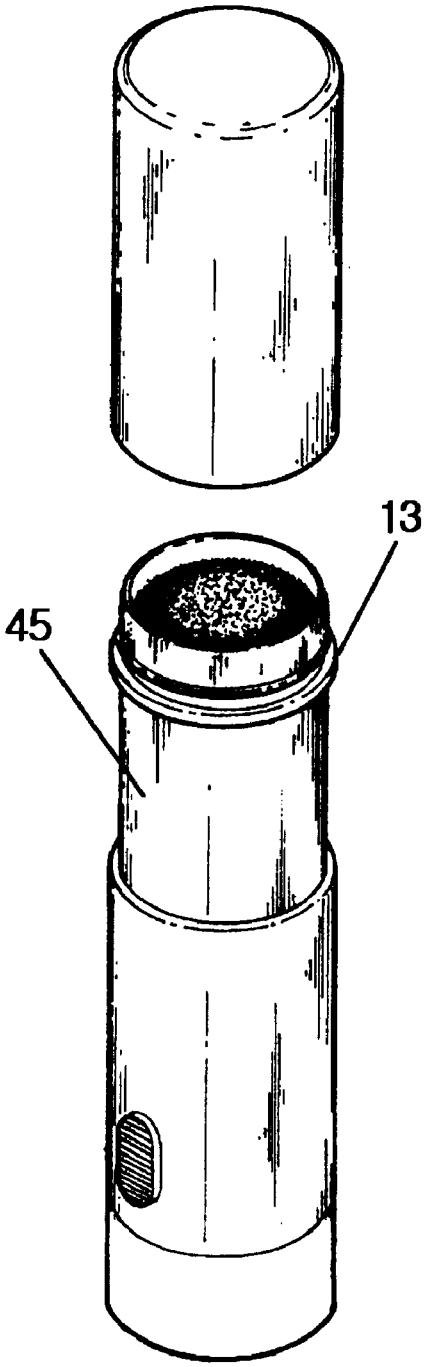
FIG. 5 is a perspective view of a cosmetic brush having a powder tube in a state in which an upper case is opened and a brush guide is lifted upward.

FIG. 4 is a perspective view illustrating the case in which an upper case 11 is opened for use of a cosmetic brush having a powder tube, and FIG. 5 is a perspective view illustrating, the case in which a brush guide 45 is lifted upward for orderly arranging a brush 41 which is messed up after the cosmetic brush having a powder tube is used. The brush guide 45 in which the powder tube 61 and the powder lid 63 are connected, slidably escapes upward before the upper case 11 is closed after the use of the cosmetic brush having a powder tube according to the present invention is completed, so that the brush 41 which is messed up due to use is restored into the original state. The brush guide 45 having, escaped upward is locked with a locking portion (not shown) formed on the powder lid 63, so that it does not protrude outward. A concave portion (71 of FIG. 7) of the upper case 11 is fitted into a convex portion (81 of FIG. 8) of the brush guide 45. The lower end of the upper case 11 is locked with the upper end of the locking, portion 13 of the brush guide 45 and simultaneously moves downwards thereby brine the lower end of the locking portion 13 of the brush guide 45 into contact with the top surface of the lower case 15, thereby forming a cosmetic brush having a powder tube.

As shown in FIG. 6, openings 83 (FIG. 8) are formed on the brush guide 45 so that when the guide is lowered into the lower case 15 they are opposite pressing buttons 17 fitted into holes in a side wall of the lower case. The buttons can then be presssed during use so that the powder is from the powder tube 61 made of an elastic material through the spray orifice 69 of the powder lid 63 without interference between the brush guide 45 and the pressing buttons.

A plate spring (not shown) and a silicon packing 62 may be further provided, in addition to the elements of the cosmetic brush having a powder tube according to the present invention. The plate spring is inserted into a space formed by the lower cap 19 the brush guide 45 and the powder tube 61, and functions to increase elasticity for facilitating restoration of the powder tube 61 into an original state when the powder tube is restored by the elasticity alter pressing the opposed pressing devices 17. The silicon packing 62 have grooves radially disposed, for example, cross-shaped. Here, the shape of the grooves may differ according to the amount of powder sprayed. The silicon packing 62 is inserted between the powder tube 61 and the powder lid 63 connected to each other and serves as a film for preventing the powder exceeding a predetermined amount from being sprayed due to a pressure caused by the pressing devices 17.

As described above, according to the present invention, powder and a brush can be simultaneously used and the brush can be inserted into a housing into the original state after using the same. Also, the powder tube containing the powder can be replaced, thereby maximizing the convenience in use.

What is claimed is:

1. A cosmetic brush having a powder tube comprising:

a housing having a lower case and a removable upper case connected to said lower case;

an elastic powder tube for accommodating powder insertable removed positioned in a lower end of the lower case;

a powder lid fixed in an upper end of the lower case and into which an upper end of the powder tube is screwed to hold the tube in the lower case, said powder lid having a spray orifice formed on an upper surface thereof so that said spray orifice projects upwardly from the lid away from the powder tube and the lower case;

a brush having densely distributed bristles fixed to the top surface of the powder lid, so that the bristles extend upwardly and outwardly of the lower case and surround the spray orifice, whereby the brush uniformly distributes powder sprayed from the powder tube onto a user's face;

a removable lower cap for closing off said lower end of the lower case;

a slidable brush guide located inside the lower case that is moveable up and down between a raised position where the guide surrounds an outer periphery of the brush's bristles and lowered position inside said lower case; and at least one pressing button located in a side wall of the lower case for pressing the powder tube and spraying powder from said spray orifice;

said upper case enclosing the brush when it is connected to said lower case.

* * * * *

UNITED STATES PATENT AND TRADEMARK OFFICE

CERTIFICATE OF CORRECTION

PATENT NO. : 6,318,380 B1
DATED : November 20, 2001
INVENTOR(S) : Jae Kwang Hwang It is certified that error appears in the above-identified patent and that said Letters Patent is hereby corrected as shown below:

Column 3,
Lines 11-12, "insertable removed" should read -- removably --.

Signed and Sealed this

Twenty-eighth Day of May, 2002

*Attest:*

*Attesting Officer*

JAMES E. ROGAN
*Director of the United States Patent and Trademark Office*